US007779577B2

(12) United States Patent
Zayac

(10) Patent No.: US 7,779,577 B2
(45) Date of Patent: Aug. 24, 2010

(54) SASH REINFORCEMENT FOR AN OPERATOR WINDOW

(75) Inventor: James Patrick Zayac, Winnipeg (CA)

(73) Assignee: Polar Window of Canada Ltd., Winnipeg, Manitoba (CA)

( * ) Notice: Subject to any disclaimer, the term of this patent is extended or adjusted under 35 U.S.C. 154(b) by 832 days.

(21) Appl. No.: 11/449,690

(22) Filed: Jun. 9, 2006

(65) Prior Publication Data

US 2008/0000162 A1 Jan. 3, 2008

(51) Int. Cl.
*E05C 9/00* (2006.01)

(52) U.S. Cl. ..... 49/395; 49/400

(58) Field of Classification Search ..... 49/394, 49/395, 400; 292/32, 137, 143, 145, 146, 292/150, 340, DIG. 18, DIG. 20, DIG. 33, 292/DIG. 47

See application file for complete search history.

(56) References Cited

U.S. PATENT DOCUMENTS 3,976,317 A * 8/1976 Collier ..... 292/340
4,743,053 A * 5/1988 King ..... 292/139
4,770,452 A * 9/1988 Petree, Jr. ..... 292/340
4,773,682 A * 9/1988 Saelzer ..... 292/143
4,802,701 A * 2/1989 Mazie ..... 292/340
4,803,808 A * 2/1989 Greisner ..... 49/394
4,991,886 A * 2/1991 Nolte et al. ..... 292/161
5,083,398 A * 1/1992 Kolbeck et al. ..... 49/395
5,241,790 A * 9/1993 Schimpf ..... 49/504
5,370,428 A * 12/1994 Dreifert et al. ..... 292/161
5,741,031 A * 4/1998 Bauman et al. ..... 292/139
5,784,839 A * 7/1998 LaVanway ..... 52/204.1
5,813,710 A * 9/1998 Anderson ..... 292/336.3
6,109,668 A * 8/2000 Demarco ..... 292/161
6,698,970 B2 * 3/2004 Guillemet et al. ..... 403/373
6,837,004 B2 * 1/2005 Annes ..... 49/394

* cited by examiner

*Primary Examiner*—Katherine W Mitchell
*Assistant Examiner*—Michael J Keller
(74) *Attorney, Agent, or Firm*—Ade + Company Inc; Ryan W. Dupuis; Kyle R. Satterthwaite

(57) ABSTRACT

In an operator window including a perimeter frame supporting a sash therein for movement between respective open and closed positions, a plurality of reinforcement members are mounted within the sash to provide reinforcement to a latching mechanism secured thereto. When the latching mechanism comprises a plurality of separate latching points at spaced positions along a latching side of the sash, a separate reinforcement member is associated with each of the latching points which is independent and maintained in separation from the remaining reinforcement members by spacers mounted therebetween. The spacers ensure sufficient space between the reinforcement members to accommodate for differences in thermal expansion and contraction between the different materials of the reinforcement members and the sash.

6 Claims, 2 Drawing Sheets

SASH REINFORCEMENT FOR AN OPERATOR WINDOW

FIELD OF THE INVENTION

The present invention relates to a reinforcement for insertion into a sash of an operator window formed of plastic hollow members to which a latch or lock mechanism can be secured.

BACKGROUND

Various types of operator windows are known in which a sash is movable relative to a perimeter frame between respective open and closed positions of the window. Locking or latching the window closed typically requires a plurality of connectors to be mounted along mating edges of the sash and the perimeter frame for engagement with one another. When securing a connector, for example a lock keeper, to a sash formed of hollow plastic members, fasteners are known to come loose from the sash over time. A reinforcement member can be mounted in the hollow plastic member forming the sash to span between an adjacent pair of lock keepers, however in regions where climate fluctuates considerably between different seasonal temperatures, the different rates of expansion and contraction of the reinforcement member and the plastic of the sash can cause the sash to bow and not fit properly within the perimeter frame.

SUMMARY OF THE INVENTION

According to one aspect of the invention there is provided in an operator window comprising:

a perimeter frame arranged to be mounted about a perimeter of a window opening, the perimeter frame including a latching side;

a sash supported on the perimeter frame and arranged to be movable relative to the perimeter frame between opened position and closed positions of the window, the sash including a latching side arranged to engage the latching side of the perimeter frame in the closed position of the window, the latching side comprising an elongate hollow member; and a latching mechanism including a plurality of first mating connectors supported at spaced positions along the latching side of the perimeter frame and a plurality of second mating connectors supported at spaced positions along the latching side of the sash, the second mating connectors being arranged to mate with respective ones of the first mating connectors so as to latch the sash in relation to the perimeter frame in the closed position of the window;

an improvement comprising a plurality of reinforcement members received through the elongate hollow member forming the latching side of the sash at spaced positions along the elongate hollow member, each reinforcement member being fastened to a respective one of the second mating connectors such that said reinforcement member is spaced apart from the other reinforcement members.

According to a second aspect of the present invention there is provided a method of reinforcing a sash in an operator window comprising:

a perimeter frame arranged to be mounted about a perimeter of a window opening, the perimeter frame including a latching side;

a sash supported on the perimeter frame and arranged to be movable relative to the perimeter frame between opened position and closed positions of the window, the sash including a latching side arranged to engage the latching side of the perimeter frame in the closed position of the window, the latching side comprising an elongate hollow member;

a latching mechanism including a plurality of first mating connectors supported at spaced positions along the latching side of the perimeter frame and a plurality of second mating connectors supported at spaced positions along the latching side of the sash, the second mating connectors being arranged to mate with respective ones of the first mating connectors so as to latch the sash in relation to the perimeter frame in the closed position of the window;

the method comprising:

inserting a plurality of reinforcement members through the elongate hollow member forming the latching side of the sash;

positioning the reinforcement members spaced apart from one another; and fastening each reinforcement member to a respective one of the second mating connectors.

According to a further aspect of the present invention there is provided an operator window comprising:

a perimeter frame arranged to be mounted about a perimeter of a window opening, the perimeter frame including a latching side;

a sash supported on the perimeter frame and arranged to be movable relative to the perimeter frame between opened position and closed positions of the window, the sash including a latching side arranged to engage the latching side of the perimeter frame in the closed position of the window, the latching side comprising an elongate hollow member;

a latching mechanism including a plurality of first mating connectors supported at spaced positions along the latching side of the perimeter frame and a plurality of second mating connectors supported at spaced positions along the latching side of the sash, the second mating connectors being arranged to mate with respective ones of the first mating connectors so as to latch the sash in relation to the perimeter frame in the closed position of the window; and a plurality of reinforcement members received through the elongate hollow member forming the latching side of the sash at spaced positions along the elongate hollow member, each reinforcement member being fastened to a respective one of the second mating connectors such that said reinforcement member is spaced apart from the other reinforcement members.

By providing a plurality of independent reinforcement members which are mounted spaced apart from one another within the latching side of a sash, mating connectors of a latching mechanism can be secured to the reinforcement members within the sash without concern for different rates of expansion and contraction between the different materials of the reinforcement members and sash as the space between the reinforcement members accommodates for different amounts of expansion and contraction responsive to temperature variation as noted in the background without forcing the sash to bow.

There may be provided a spacer mounted between each adjacent pair of reinforcement members to maintain the spacing therebetween during installation with the spacers being small enough that the reinforcement members may be installed with a gap between each spacer and the adjacent reinforcement members.

Preferably the spacer substantially fully spans a cross section of a hollow channel receiving the reinforcement members in the elongate hollow member forming the latching side of the sash.

The spacer may be formed of a plastic material which is softer than both the material forming the reinforcement members and the material of the elongate hollow member forming the latching side of the sash.

The reinforcement members are preferably formed of metal with the elongate hollow member forming the latching side of the sash being formed of plastic material.

The method of installation of the reinforcement members may include positioning the latching side of the sash to span generally horizontally prior to fastening each reinforcement member to a respective one of the second mating connectors. The method may further include tilting the latching side of the sash to slope downwardly towards a first end and securing second mating connector to the reinforcement member nearest to the first end, and subsequently tilting the latching side of the sash to slope downwardly towards a second end and securing the second mating connector to the reinforcement member nearest to the second end.

When providing more than two second mating connectors, the method preferably includes fastening intermediate ones of the second mating connectors to the respective reinforcement members prior to fastening outermost ones of the second mating connectors to the respective reinforcement members.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
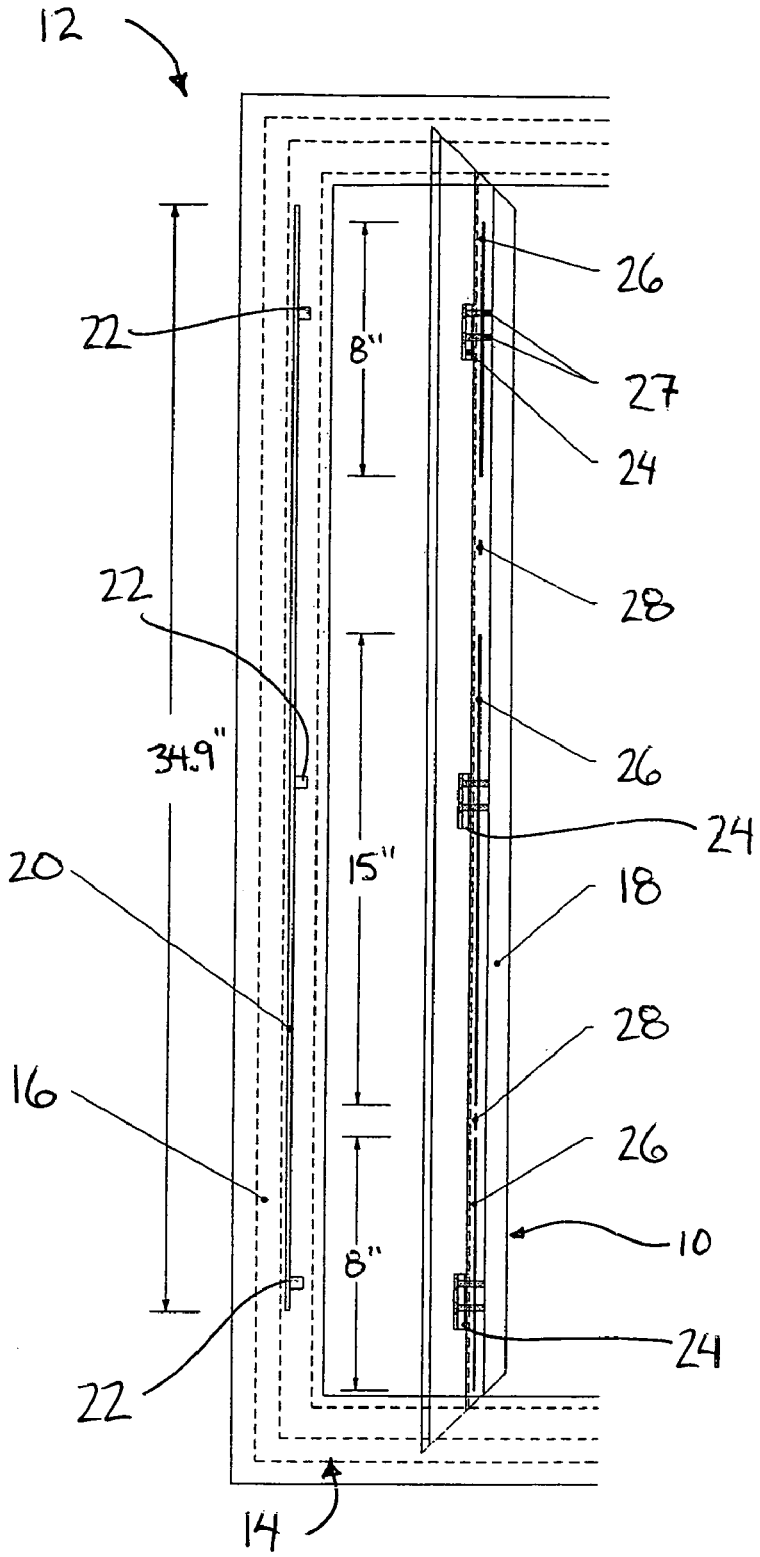
FIG. 1 is a front elevational view of a latching side of both a perimeter frame and a sash of an operator window.

Referring to the accompanying figures there is illustrated a reinforcement for a sash 10 of an operator window 12. More particularly the reinforcement is arranged for reinforcing the attachment of a latching mechanism to an operator window formed of hollow plastic frame members.

The present invention is generally applicable to an operator window 12 of the type having a perimeter frame 14 arranged to be mounted about a perimeter of a window opening. A latching side 16 of the perimeter frame is shown formed of a hollow plastic frame member joined to similar hollow plastic frame members forming the top and bottom sides of the perimeter frame.

As in a conventional operator window, the sash 10 is mounted within the perimeter frame 14 for movement relative thereto between an open position in which the window opening surrounded by the perimeter frame is at least partially unobstructed and a closed position in which window panes fully span the window opening. The sash itself thus at least partially obstructs the window opening in the closed position. The sash also includes a latching side 18 formed of an elongate hollow plastic member, for example vinyl. The latching side 18 of the sash is opposite the hinged or otherwise mounted side of the sash which supports the sash on the perimeter frame 14. The latching sides 16 and 18 of the perimeter frame and sash respectively engage one another in the closed position of the window.

A latching mechanism is provided for latching or locking the sash relative to the perimeter frame in the closed position. The latching mechanism includes a common multipoint lock tie bar 20 which is mounted along the latching side of the perimeter frame for relative sliding movement in the longitudinal direction of the bar along the frame. The tie bar 20 includes a plurality of first mating connectors 22 mounted at spaced positions therealong. A set of three first mating connectors 22 is shown in the illustrated embodiment.

The latching mechanism also includes a set of lock keepers comprising second mating connectors 24 mounted at spaced positions along the latching side of the sash. The second mating connectors 24 correspond in number and location to the first mating connectors 22 so as to be similarly spaced for alignment of the first and second connectors in the closed position. The first and second mating connectors are thus arranged to mate with one another respectively to latch or lock the window in the closed position. Slidably displacing the tie bar 20 in the longitudinal direction thereof along the latching side of the frame causes the mating connectors to be selectively engaged with one another in the closed position of the window.

The reinforcement according to the present invention comprises a plurality of separate reinforcement members 26 which are supported spaced apart from one another along the latching side of the sash for respective alignment with the second mating connectors 24 so that the second mating connectors can be fastened to the sash by fastening to respective ones of the reinforcement members 26 using screws 27 shown in the Figures fastened between the external mating connectors 24 and the internal reinforcement members 26 or other suitable threaded fasteners and the like. The reinforcement members 26 are formed of steel or any other suitable material which is stronger than the plastic material forming the sash for better securement of the screws 27 therein when securing the second mating connectors to the sash.

Figure 2:
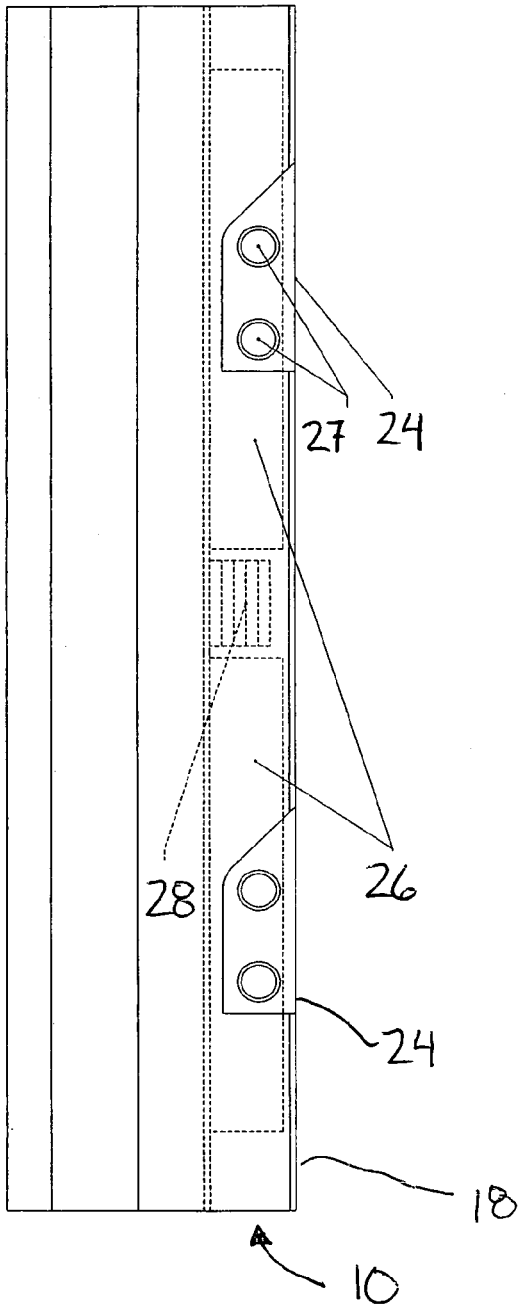
FIG. 2 is a side elevational view of a member forming the latching side of the sash.
Figure 3:
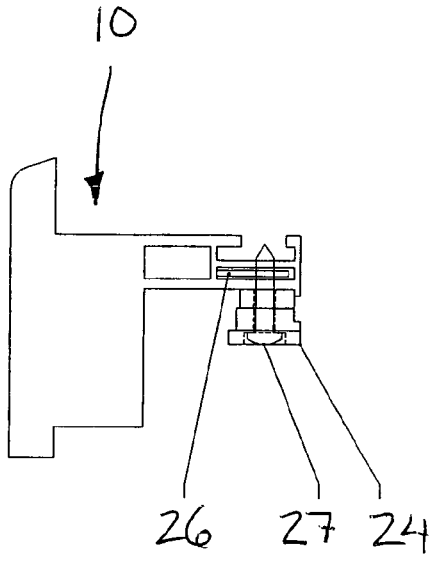
FIG. 3 is an end view of the member forming the latching side of the sash.

As shown in FIG. 3, an enclosed hollow channel is formed integrally in the sash to span in the longitudinal direction of the latching side of the sash adjacent the mounting location of the second mating connectors 24. As shown in FIGS. 1 through 3, the reinforcement members 26 are thus longitudinally slidably received fully internally in the enclosed hollow channel formed in the frame member of the sash so as to be inserted in series with one another at spaced apart positions therein.

Each reinforcement member 26 comprises a flat steel bar which is plural times in length in the longitudinal direction shown in FIG. 1 than that of a corresponding external second mating connector 24 which is fastened to it so as to be elongate in the longitudinal direction of the channel.

As shown in FIG. 2 spacers 28 formed of a dissimilar material, for example PVC plastic, are mounted in the hollow channel between each adjacent pair of the reinforcement members 26 so as to be in series therewith to maintain a space therebetween in the mounted position thereof. The spacers are much shorter in the longitudinal direction than the reinforcement members 26.

Each spacer 28 is arranged to span the full cross section of the hollow channel receiving the reinforcement members 26 therein to prevent any sliding overlap of the plates within the hollow channel of the sash. Each spacer is thus positioned between the ends of two adjacent reinforcement members.

The spacers 28 are formed of a soft plastic material which is arranged to be softer than the steel of the reinforcement members 26 as well as being softer than the vinyl forming the frame members of the sash and perimeter frame of the windows. The force required to compress the spacers 28 is arranged to be less that the force in the longitudinal direction of the latching side of the sash which would be required to cause the sash to bow. Accordingly, the spacers are soft enough to allow some deformation thereof rather than allowing bowing of the sash responsive to thermal expansion and contraction as noted in the background.

To further ensure that there are no undesirable forces causing the window sash to bow, the combined length of all of the reinforcement members 26 and the spacers in the longitudinal direction of the latching side of the sash is arranged to be shorter than that of the sash so that the spacers and reinforcement members 26. Accordingly gaps are installed between all of the spacers and the reinforcement members which accommodate for any differences in expansion or contraction between the reinforcement members and the latching side of the sash.

When more than two second mating connectors 24 are provided, the reinforcement members 26 which are located at opposing ends of the latching side of the sash are arranged to be shorter in the longitudinal direction thereof than any intermediate ones of the reinforcement members 26.

The members 26 located adjacent the opposing ends of the sash are also arranged to be longer than the distance between the outermost ones of the second connectors 24 and the respective outer ends of the sash in the longitudinal direction of the latching side to ensure that even when the reinforcement members 26 at the opposing ends are abutted against the respective opposing ends, they still overlap the mounting locations of the two outer second mating connectors 24.

Furthermore the intermediate reinforcement members 26 are arranged to have a length which will overlap the respective intermediate ones of the second mating connectors with which they are associated even if all of the reinforcement members are abutted against one another adjacent one end of the latching side of the sash or the other.

Depending upon the length of the latching side of the sash, a different number of second mating connectors 24 are provided and different lengths of reinforcement members 26 inserted within the hollow interior of the sash frame member are also provided. The following table illustrates the different lengths of reinforcement members 26 which can be used for different lengths of latching sides of the sash. In the illustrated embodiment for example when the tie bar has a length of 34.9 inches, three second mating connectors 24 are provided with three associated reinforcement members 26. The two outermost members 26 have a length of 8 inches in the longitudinal direction while an intermediate one of the reinforcement members has a length of the 15 inches.

| TIE BAR SIZES | REINFORCEMENT MEMBERS LENGTH AND POSITION | | | |
|---|---|---|---|---|
| (INCHES) | 1 | 2 | 3 | 4 |
| 26.9 OR LESS | 8" | 8" | | |
| 30.9 | 8" | 13" | 8" | |
| 34.9 | 8" | 15" | 8" | |
| 38.9 | 8" | 17" | 8" | |
| 42.9 | 8" | 19" | 8" | |
| 46.9 | 8" | 21" | 8" | |
| 50.9 | 8" | 23" | 8" | |
| 54.9 | 8" | 25" | 8" | |
| 58.9 | 8" | 27" | 8" | |
| 62.9 | 8" | 21" | 21" | 8" |
| 66.9 | 8" | 21" | 21" | 8" |
| 70.9 | 8" | 23" | 23" | 8" |

In order to assemble the sash with the steel reinforcement members 26 inserted therein, the correct number and layout of reinforcement members are selected from the above chart and inserted in order with the spacers 28 abutted therebetween. The latching side of the sash is then positioned to span generally horizontally and can be quickly moved side to side to further separate the steel of the reinforcement members from the spacers 28 to maintain a gap therebetween. The central or intermediate one of the lock keepers forming the second mating connectors 24 can then be fastened to its respective reinforcement member 26 using suitable fasteners therebetween.

The latching side of the sash is then tilted to one end until the reinforcement member 26 at that end abuts the respective end of the sash. At this point the second mating connector 24 at that bottom end of the sash is then applied with fasteners. The process is then repeated by tilting the sash to the other direction so that the other end is located at the bottom and then the corresponding second mating connector 24 adjacent to that bottom end is then secured to the respective reinforcement member 26.

The spacers 28 serve primarily to ensure that the reinforcement members 26 cannot slide past or overlap one another when they are slidably inserted into the hollow channel formed in the sash.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. An operator window comprising:

a perimeter frame arranged to be mounted about a perimeter of a window opening, the perimeter frame including a latching side;

a sash supported on the perimeter frame and arranged to be movable relative to the perimeter frame between opened and closed positions of the window, the sash including a latching side arranged to engage the latching side of the perimeter frame in the closed position of the window, the latching side comprising an elongate hollow member having an integral enclosed hollow channel extending in a longitudinal direction of the elongate hollow member;

a latching mechanism including a plurality of first mating connectors supported at spaced positions along the latching side of the perimeter frame and a plurality of second mating connectors supported at spaced positions along the latching side of the sash, the second mating connectors being arranged to mate with respective ones of the first mating connectors so as to latch the sash in relation to the perimeter frame in the closed position of the window; and a plurality of separate elongate reinforcement members fully received within the enclosed hollow channel of the elongate hollow member forming the latching side of the sash;

the reinforcement members being located at spaced positions along the elongate hollow member so as to be arranged to be slidable in the longitudinal direction of the elongate hollow member;

the reinforcement members being fastened by respective fasteners to respective ones of the second mating connectors such that each-reinforcement member is spaced apart from the other reinforcement members; and each of the fasteners being fastened between the respective reinforcement member fully received within the enclosed hollow channel of the elongate hollow member and the respective second mating connector supported fully externally of the enclosed hollow channel of elongate hollow member; and a spacer received within the enclosed hollow channel of the elongate hollow member between each adjacent pair of reinforcement members;

each spacer fully spanning a cross section of the enclosed hollow channel receiving the reinforcement members in the elongate hollow member forming the latching side of the sash so as to be arranged to prevent the reinforcement members from overlapping one another in the enclosed hollow channel of the elongate hollow member; and each spacer being formed of a material which is softer than the material forming the reinforcement members and the material of the elongate hollow member forming the latching side of the sash such that the force required to compress each spacer is arranged to be less than the force which would be required to cause the sash to bow resulting from any differences in expansion and contraction between the reinforcement members and the latching side of the sash.

2. The operator window according to claim 1 wherein there is provided a gap between the spacer and each reinforcement member.

3. The operator window according to claim 1 wherein the reinforcement members are formed of metal and the elongate hollow member forming the latching side of the sash is formed of plastic material.

4. In an operator window comprising:

a perimeter frame arranged to be mounted about a perimeter of a window opening, the perimeter frame including a latching side;

a sash supported on the perimeter frame and arranged to be movable relative to the perimeter frame between opened and closed positions of the window, the sash including a latching side arranged to engage the latching side of the perimeter frame in the closed position of the window, the latching side comprising an elongate hollow member having an integral enclosed hollow channel extending in a longitudinal direction of the elongate hollow member; and a latching mechanism including a plurality of first mating connectors supported at spaced positions along the latching side of the perimeter frame and a plurality of second mating connectors supported at spaced positions along the latching side of the sash, the second mating connectors being arranged to mate with respective ones of the first mating connectors so as to latch the sash in relation to the perimeter frame in the closed position of the window;

an improvement comprising:

a plurality of separate elongate reinforcement members received within the enclosed hollow channel of the elongate hollow member forming the latching side of the sash;

the reinforcement members being located at spaced positions along the elongate hollow member so as to be arranged to be slidable in the longitudinal direction of the elongate hollow member;

the reinforcement members being fastened by respective fasteners to respective ones of the second mating connectors such that each reinforcement member is spaced apart from the other reinforcement members;

each of the fasteners being fastened between the respective reinforcement member received within the enclosed hollow channel of the elongate hollow member and the respective second mating connector supported externally of the enclosed hollow channel of the elongate hollow member; and a spacer received within the enclosed hollow channel of the elongate hollow member between each adjacent pair of reinforcement members;

each spacer fully spanning a cross section of the enclosed hollow channel receiving the reinforcement members in the elongate hollow member forming the latching side of the sash so as to be arranged to prevent the reinforcement members from overlapping one another in the enclosed hollow channel of the elongate hollow member; and each spacer being formed of a material which is softer than the material forming the reinforcement members and the material of the elongate hollow member forming the latching side of the sash such that the force required to compress each spacer is arranged to be less than the force which would be required to cause the sash to bow resulting from any differences in expansion and contraction between the reinforcement members and the latching side of the sash.

5. The operator window according to claim 4 wherein there is provided a gap between each spacer and each reinforcement member.

6. The operator window according to claim 4 wherein there are provided gaps in the enclosed hollow channel of the hollow member between the spacers and the reinforcement members such that a combined length of the reinforcement members and the spacers therebetween in a longitudinal direction of the hollow member is less than a length of the latching side of the sash.

* * * * *